United States Patent [19]

Zeller

[11] Patent Number: 4,782,897

[45] Date of Patent: Nov. 8, 1988

[54] MULTIPLE INDEXING J-SLOT FOR MODEL E SRO VALVE

[75] Inventor: Vincent P. Zeller, Duncan, Okla.

[73] Assignee: Halliburton Company, Duncan, Okla.

[21] Appl. No.: 20,427

[22] Filed: Mar. 2, 1987

[51] Int. Cl.[4] ..... E21B 23/00

[52] U.S. Cl. ..... 166/240; 166/331

[58] Field of Search ..... 166/66, 240, 242, 331, 166/334

[56] References Cited

U.S. PATENT DOCUMENTS

| | | | |
|---|---|---|---|
| 4,355,685 | 10/1982 | Beck | 166/240 |
| 4,403,654 | 9/1983 | Haynes | 166/240 X |
| 4,403,659 | 9/1983 | Upchurch | 166/331 X |
| 4,583,592 | 4/1986 | Garda et al. | 166/242 X |
| 4,657,082 | 4/1987 | Ringgenberg | 166/331 X |

*Primary Examiner*—Stephen J. Novosad
*Assistant Examiner*—William P. Neuder
*Attorney, Agent, or Firm*—James R. Duzan; Joseph A. Walkowski

[57] ABSTRACT

The present invention comprises a novel, improved connector mechanism for connecting a probe and a pipe string portion of a wireline based data transmission system. The connector mechanism includes cooperating pin and channel means, one of said means associated with the probe and the other with the pipe string portion. The connector mechanism is especially suited for use in conjunction with a combined tubing conveyed perforating and drill stem testing operations due to the present invention's resistance to unwanted disengagement responsive to jarring or shock waves such as are generated by perforating guns.

12 Claims, 5 Drawing Sheets

MULTIPLE INDEXING J-SLOT FOR MODEL E SRO VALVE

BACKGROUND OF THE INVENTION

This invention relates generally to downhole tools which are invention relates more particularly, but not by way of limitation, to a wireline tool and method for providing real-time surface readouts of drill stem test data generated during a combined tubing conveyed perforating and drill stem testing operation.

In drilling and operating a well, downhole tools are used to monitor downhole conditions, such as temperature and pressure, to obtain information which is helpful in evaluating the nature of the well, such as whether the well is likely to produce. One particular condition which is preferably monitored is reservoir pressure measured over periods of time during which the well is alternately allowed to flow and prevented from flowing. This condition is determined by means of a drill stem test which can be conducted utilizing the Bourdon tube technique known in the art. With this technique a chart having a pressure versus time graph scribed thereon is obtained.

A shortcoming of the Bourdon tube technique is that no real-time or substantially instantaneous readout of the sensed pressure is available at the surface while the pressure is being detected. A real-time readout is needed to permit a person at the well site to quickly know what is occurring downhole during the test periods. This shortcoming exists because to perform a drill stem test using the Bourdon tube technique, a tool containing an unscribed chart and a bourdon tube instrument are lowered into the well, the well is alternately allowed to flow and prevented from flowing to cause the Bourdon tube instrument to scribe a pressure versus time graph on the chart, and then the tool is withdrawn from the well and the chart analyzed at some relatively considerable time subsequent to the actual time at which the pressures were detected and the chart created.

Electronic, battery powered memory recorders have been developed to store data generated in response to a pressure or other transducer. However, these electronic devices suffer from the same shortcoming as the Bourdon tube technique, i.e., lack of real time readout of data during a test.

Another downhole tool known to me is capable of detecting reservoir pressures, such as during a drill stem test, and of providing real-time surface readouts of the pressure. This prior surface readout instrument includes a valve which is contained within a drill or tubing string located in the well. The valve includes a valve member which is moved downwardly into an open position in response to engagement of the valve member with a housing containing a pressure sensor which is connected by wireline to a surface readout device. Initial movement of the housing into the well is effected by lowering it on the wireline; however, further movement of the housing into engagement with the valve member, and subsequent opening of the valve, is achieved by operation of an electrical, motorized actuator sub of a type known to the art. The actuator sub engages the housing in the well and moves it farther down into the well into engagement with the valve member and on downward until the valve is opened, thereby communicating the reservoir pressure to the pressure sensor.

A tester valve with which this prior surface readout instrument is associated is periodically opened and closed to perform a drill stem test in a manner as known to the art. During the drill stem test, the pressures are detected through the open valve and electrically communicated to the surface via the wireline. When the test has been completed, the actuator sub moves the housing upward in response to electrical commands from the surface. Once the actuator sub has fully disengaged the housing from the valve, the housing and actuator sub assembly are pulled out of the well by reeling in the wireline.

One disadvantage of this prior art surface readout instrument is that it requires electrical power to operate the motor of the actuator sub to engage and disengage the housing (and associated pressure sensor) and the valve member. If the motor fails to operate or if electrical continuity to the motor is lost or if the wireline or cable head develops a short-circuit, for example, the housing and valve member cannot be engaged or disengaged. Such electrical problems are rather frequent because of the extreme downhole environments which are encountered in a well and the relatively long periods of time (days, sometimes) during which the instrument is kept in the well. Another shortcoming of this prior surface readout instrument is that the actuator sub is a complex tool which is difficult to manufacture and difficult to maintain in the field. It is also a relatively expensive tool. Still another shortcoming of the prior art surface readout instrument is that it is relatively long, being almost seventeen feet long in one embodiment of which we are aware. Another type of downhole tool by means of which downhole pressures can be detected and their magnitudes communicated to the surface includes a pressure sensing probe installed in a section of pipe of a pipe string which is to be disposed in the well. This probe is exposed to the borehole environment when the pipe string is in the well, and thus it must be durably constructed to endure the extremes found therein. The magnitude of the pressure detected by this type of probe is communicated to the surface via a connector tool which couples with the probe. The connector tool can be relatively easily removed from the well if a problem occurs; however, if the probe malfunctions or otherwise needs to be removed, the entire pipe string must be removed. This is a significant disadvantage because of the time and expense of tripping the pipe string out of and back into the well.

Therefore, in view of the disadvantages of the aforementioned prior art devices of which we are aware, there was a need for an improved downhole tool and an improved method for using the tool, which tool and method are disclosed in U.S. Pat. No. 4,509,174, issued on Apr. 2, 1985 to Skinner et al, and assigned to the assignee of the present invention.

In particular, this improved tool is able to sense reservoir pressure which is to be monitored during a drill stem test, for example, and to communicate the magnitude of the sensed pressure to the surface for providing a real-time readout of the pressure magnitude.

The aforesaid tool is constructed so that it can be installed and removed with downhole mechanical means, rather than downhole electrical means, to obviate the necessity of an actuator sub and the related electrical circuitry which is subject to the aforementioned problems. To assist in the mechanical manipulation of the tool, there is included means for jarring, or applying force impulses, to the tool to assist in the mechanical coupling and decoupling of the tool elements. The tool also includes a housing for protectively containing a sensor, which housing and sensor can be removed from the well without removing the pipe string in which the tool is to be used, and is constructed to be relatively compact to enhance the transportability of the tool to the well site and the handling of the tool at the well site.

While a great improvement over other prior art devices, the Skinner et al tool has been found to suffer from a deficiency which arises where a drill stem test is conducted in conjunction with a tubing conveyed perforating operation.

In tubing conveyed perforating, which is well known in the art, a "gun" or guns containing a number of shaped charges is lowered into a well bore at the bottom of a string of tubing or drill pipe, and the charges fired to perforate the well bore casing and adjacent producing formation. The advantages of tubing conveyed perforating, as opposed to wireline perforating wherein charges are run on wireline through the tubing or drill pipe, include greater shot density, the ability to perforate in an underbalanced condition (wherein the formation is exposed to a lesser pressure in the tubing string than the hydrostatic present in the annulus) and the ability to perforate virtually unlimited intervals, or lengths, of formation in one trip into the well To further compound the advantages of tubing conveyed perforating, a technique has been developed wherein drill stem test tools are run into the well above the tubing conveyed perforating gun or guns on the same tubing or drill pipe string, and a drill stem test is conducted immediately subsequent to the firing of the guns rather than at a later time during a subsequent trip into the well.

More specific and detailed descriptions of tubing conveyed perforating alone and in conjunction with drill stem testing may be found, respectively, in U.S. Pat. Nos. 3,706,344 and 4,480,690, assigned to the assignee of the present invention.

It has been found, when conducting a combined tubing conveyed perforating/drill stem testing operating using the real-time surface readout apparatus described in the aforesaid Skinner et al patent, that the connector mechanism by which the probe portion of the apparatus (run on wireline) is secured to the pipe portion of the apparatus (run into the well as part of the tool string) disconnects itself in some instances when hit by the shock wave generated by the firing of the perforating guns. This is due to the nature of the design of the connector mechanism, which connects and disconnects the probe to the pipe string portion in response to reciprocation of the probe induced by manipulation of the wireline from which the probe is suspended. Since it is generally part of such an operation to let the perforated formation flow immediately up the interior of the test string, disconnection of the probe results in the loss of valuable data as well as the possibility of the probe being carried up the string by the formation flow and tangling in or damaging the wireline, the probe itself, or the connections between the two.

SUMMARY OF THE INVENTION

The present invention comprises a novel, improved connector mechanism for connecting a probe and a pipe string portion of a surface readout drill stem testing tool assembly or other wireline based data transmission system.

The connector mechanism of the present invention includes cooperating pin means and channel means, one of said means associated with a probe and the other associated with a pipe string portion of a downhole tool assembly.

The pin means includes a plurality of pins which follow a path defined by the channel means between an engagement position, wherein each pin enters the channel means path, and a disengagement position, wherein each pin enters the channel means path.

In the preferred embodiment, three pins are employed, disposed at 90° intervals on and extending radially inwardly from the interior of the pipe portion of the downhole tool, thus having a 180° "blank" space between two of the pins. The probe portion of the tool includes the channel means path, defined on a rotating tubular collar by a continuous land at the top of the sleeve, the land having downwardly extending peninsulas defining bays therebetween. Below the peninsulas lie a plurality of support islands circumferentially disposed about the sleeve, one of said support islands including an upwardly obliquely extending deflector headland. This same support island also extends obliquely downwardly below the other islands to form an alignment headland. Below the alignment headland lie a plurality of alignment islands of similar orientation to the alignment headland.

When the probe portion sleeve encounters the pins of the pipe string portion, the pins are directed by the alignment islands and headland into alignment channels leading to passages between the support islands, and from there into the tops of bays defined between the upper land peninsulas, this latter movement being effected by contact of one of the pins with the underside of the deflector headland. Such direction is actually accommodated by rotation of the probe portion collar with respect to the stationary pins, but the description is more easily understood from the standpoint of pin movement with respect to the collar. Subsequent upward movement of the probe, initiated by the wireline, causes contact of the same pin with the upper side of the deflector headland, whereby all of the pins are directed to support coves defined on the upper ends of the support islands. Subsequent downward probe movement will cause re-entry of all pins into the bays, and upward movement, the entry of all pins into support coves, directed by the contact of the second of the three pins with the deflector headland. This sequence will continue until the last of the three pins has contacted the deflector headland, whereafter subsequent downward and upward movements of the probe portion cause the exiting of the three pins from the inter-island passages, and the probe portion can then be withdrawn from the well.

Thus it is apparent that reciprocation induced by perforation gun firing will not cause the disengagement of the probe portion from the pipe string portion of a downhole tool employing the connector mechanism of the present invention, as multiple reciprocations are required to effect such disengagement.

BRIEF DESCRIPTION OF THE DRAWINGS

The features and advantages of the present invention will be readily apparent to those skilled in the art when the following description of the preferred embodiment is read in conjunction with the accompanying drawings, wherein.

DETAILED DESCRIPTION OF THE PREFERRED EMBODIMENT

Figure 1A:
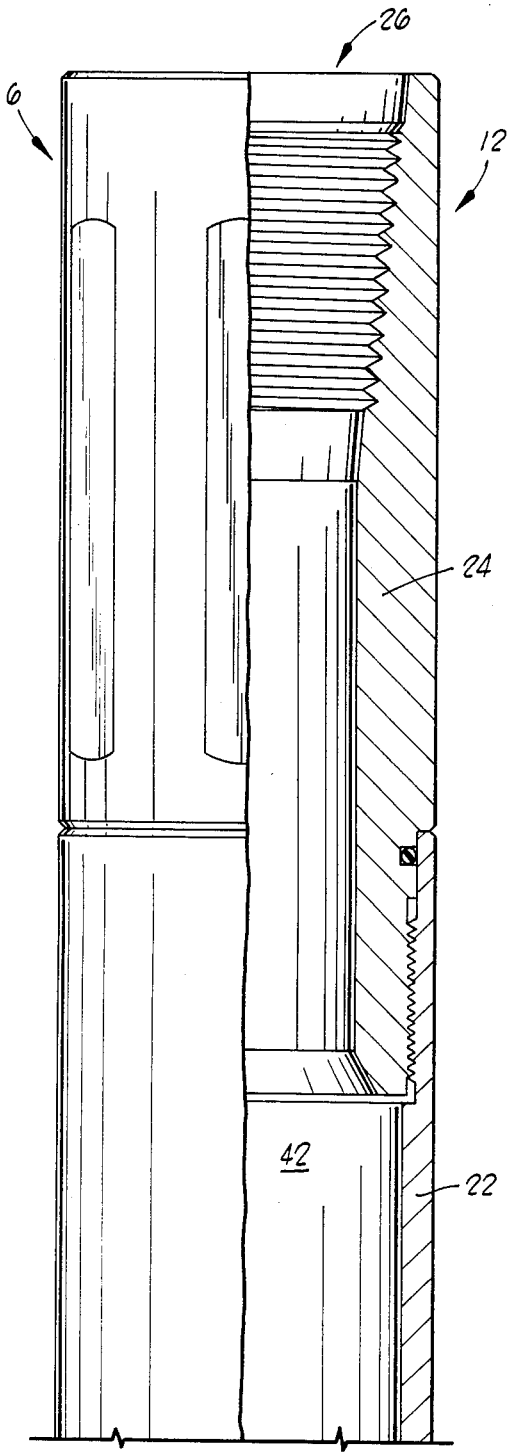
FIGS. 1A–1E form a partially sectioned elevational view of a downhole tool of a construction employing the preferred embodiment of the connector mechanism of the present invention.
Figure 1B:
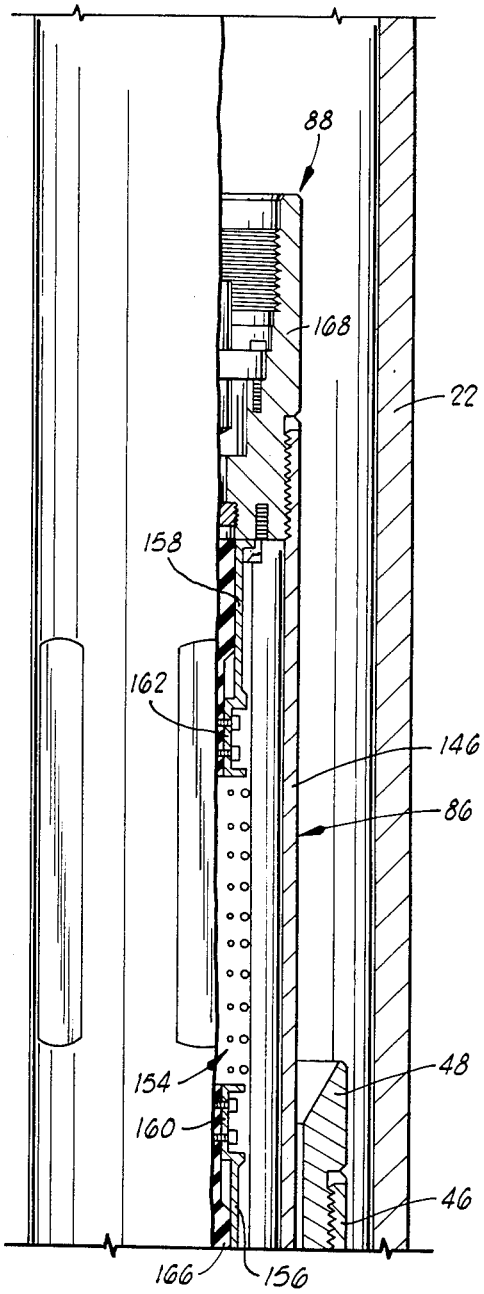
Figure 1C:
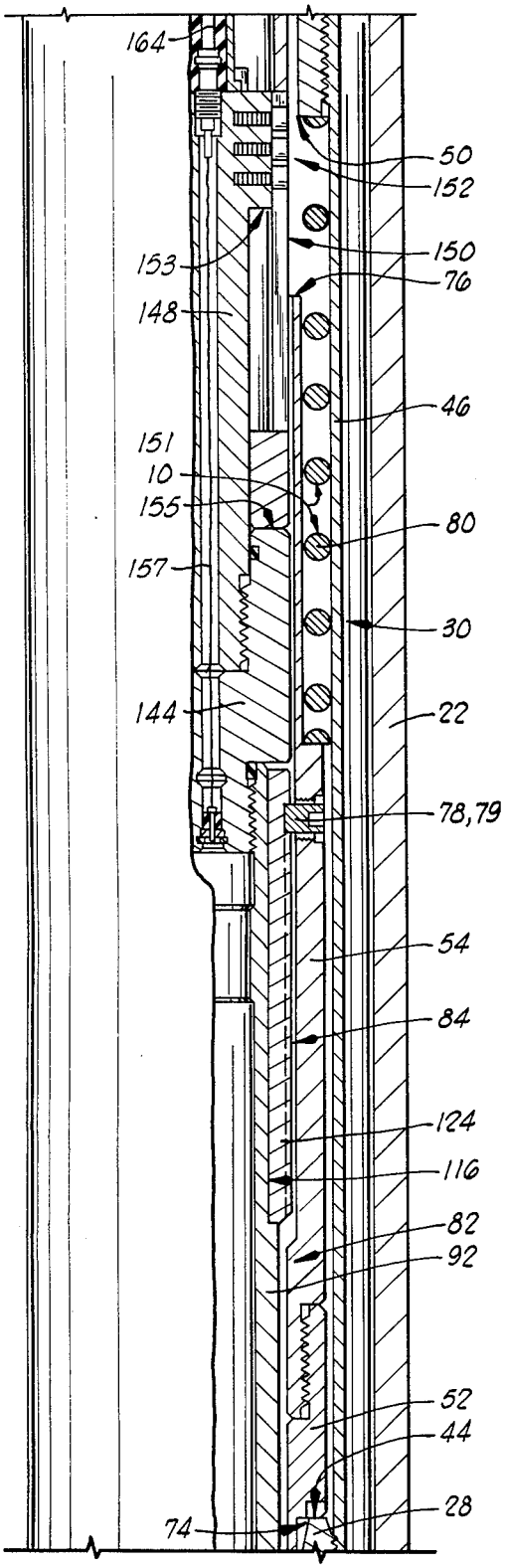
Figure 1D:
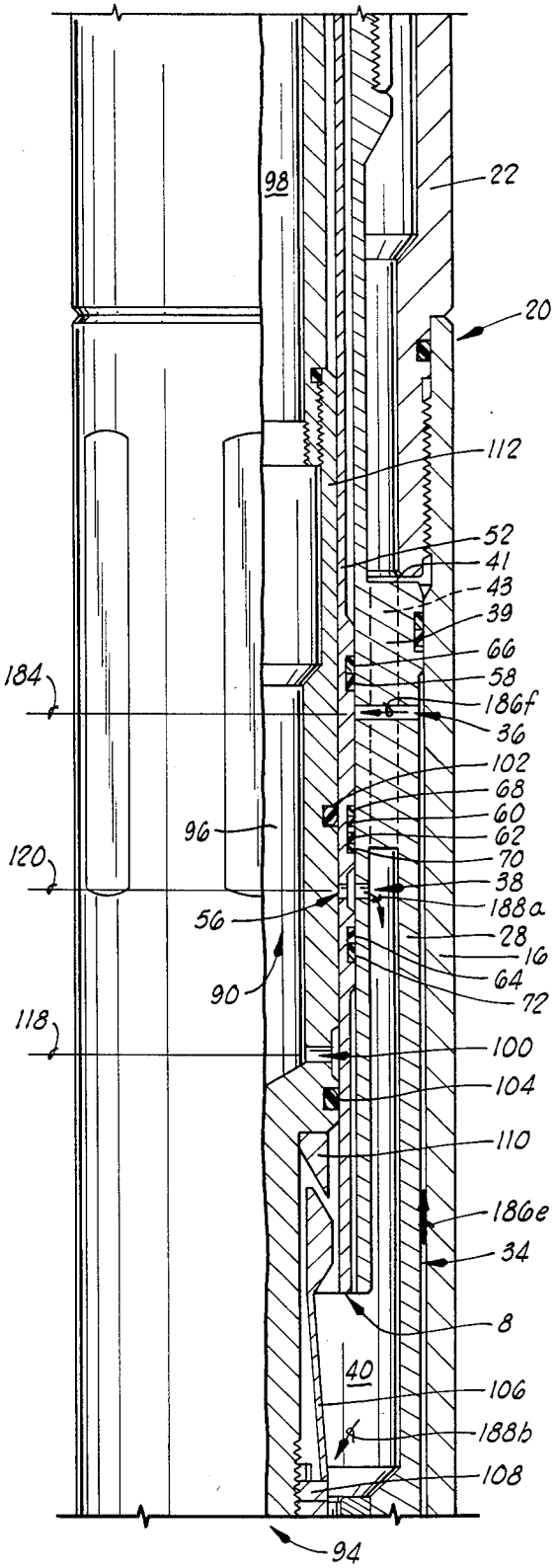
Figure 1E:
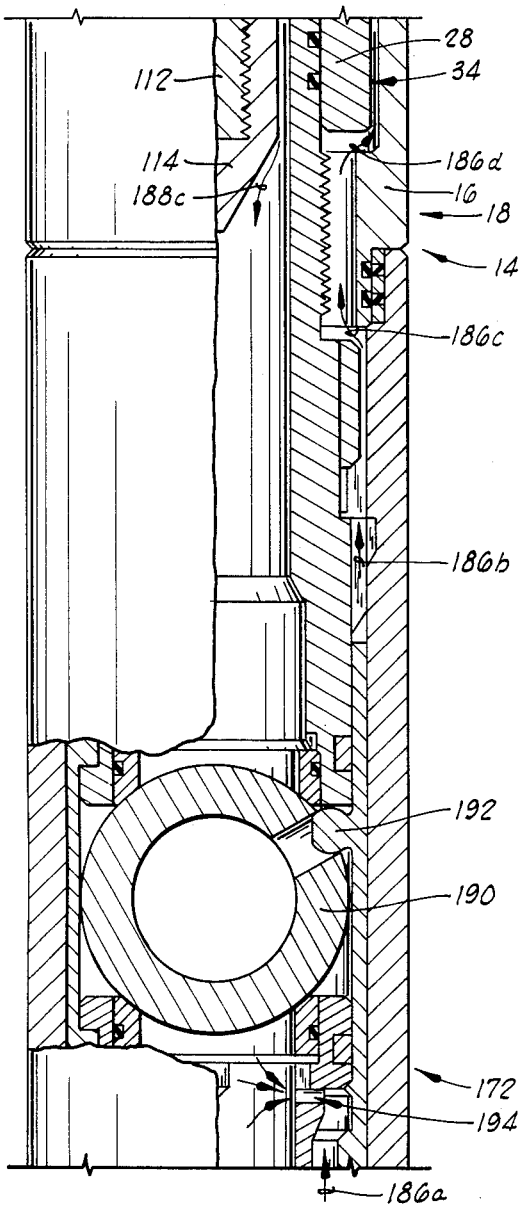
Figure 2:
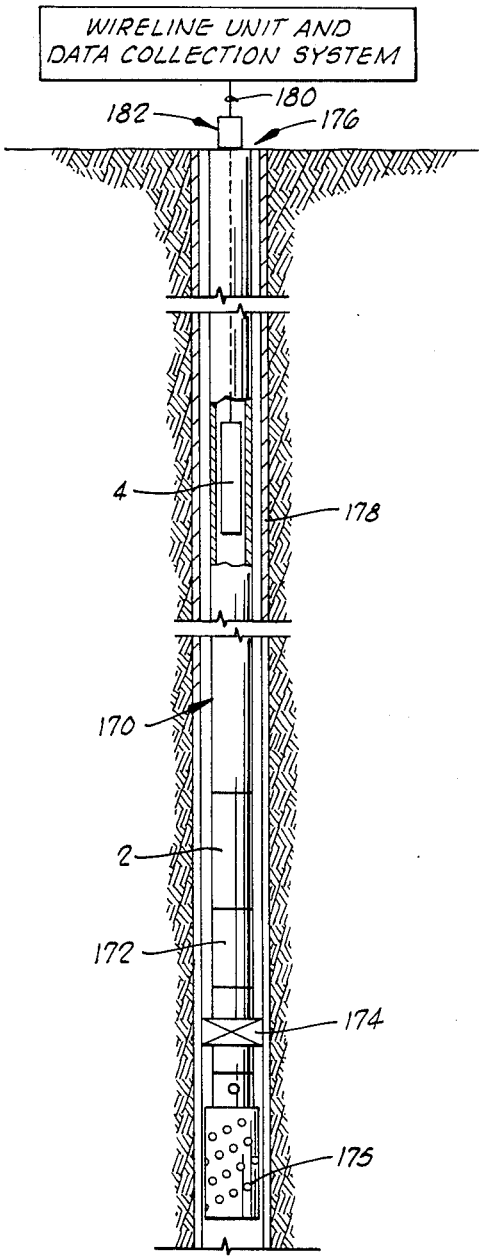
FIG. 2 is a schematic representation of the present invention associated with a pipe string disposed in a well.

With reference to the drawings, a tool constructed in accordance with the preferred embodiment of the connector mechanism of the present invention will be described. As illustrated in FIG. 2, the tool includes a pipe string portion 2 and a probe portion 4. These two portions will be hereinafter described with reference to FIGS. 1A–1E and 3.

The pipe string portion 2 is shown in FIGS. 1A–1E to broadly include support means 6 for supporting the tool in a well, slide means 8 (FIGS. 1C–1D) disposed in sliding relationship with the support means 6, and biasing means 10 (FIG. 1C) for biasing the slide means 8 toward a tool-unactuated position, which tool-unactuated position is that position in which the slide means 8 is shown in the drawings. The support means 6 has a top end 12 (FIG. 1A) and a bottom end 14 (FIG. 1E), which top end 12 is disposed closer than the bottom end to the top of the well when the support means 6 is disposed in the well. The slide means 8 is supported by the support means 6 at a position which is closer to the bottom end 14 than is the position at which the biasing means 10 is retained in the support means 6.

It is to be noted that as used herein, the words "top," "upward" and the like define positions or directions of elements which are relatively higher, as viewed in the drawings hereof or with reference to the top or mouth of the well, than are associated elements identified as "bottom," "downward" and the like.

Support means 6 is a substantially cylindrical structure comprising several elements as illustrated in the drawings. These elements are arranged in an outer structure and an inner structure. The outer structure functions as a container means for holding the inner structure and for holding the pressure, and also functions as the means by which the tool is connected into a pipe or tubing or other structure by means of which the pipe string portion 2 is retained in the well. It is to be noted that as used in the specification and claims hereof, "pipe string" is to mean that structure by which the pipe string portion 2 is held in the well, whether that structure is actually known in the art as a pipe string, a drill string, a tubing string, or other type of structure.

The outer structure, or container means, includes a cylindrical valve case 16 having a bottom end 18 and a top end 20. The bottom end 18 is connectible with a tester valve as will be subsequently described. The top end 20 is shown in FIG. 1D to be threadedly and fluid-tightly connected to a first end of a housing case 22 forming another part of the container means. The housing case 22 includes a second end which is shown in FIG. 1A to be threadedly and fluid-tightly connected to a top adapter member 24 having a threaded box end 26 for coupling with a threaded pin end of a pipe (not shown).

The inner structure which is contained within the outer structure includes a valve body 28 and retainer means 30 for retaining the biasing means 10. The valve body 28 is shown in FIGS. 1C–1E, and the retainer means 30 is shown in FIGS. 1B–1D.

The valve body 28 has a relief area 34 defining a space between the valve case 16 and the valve body 28. Reservoir or well fluid, and thus reservoir or well pressure, is always present in the region defined by the relief area 34 when the pipe string portion 2 is disposed in the well. The region defined by the relief area 34 communicates with at least one port or opening 36 defined laterally through the valve body 28 whereby the reservoir or well pressure is also present in the port 36.

The valve body 28 includes another port 38 which communicates with a cavity 40 defined in the valve body 28 as shown in FIG. 1D. The cavity 40 opens into a hollow interior portion 42 of the pipe string portion 2.

The valve body 28 also includes spiders 39 welded, as at a weld 41, into the main portion of the valve 28. The spiders 39 are spaced from each other so that openings 43 are defined therebetween. These openings 43 permit borehole fluid to flow to the surface along the passageway shown in FIGS. 1B–1D to be defined between the housing case 22 and the retainer means 30 through the adapter member 24, and through the pipe string in which the pipe string portion 2 is disposed.

The valve body 28 further includes stop means for defining a first limit of travel which limits the distance the slide means 8 can move in the downward direction. In the preferred embodiment the stop means includes a shoulder 44 defined at the top of the valve body 28. The shoulder 44 extends inwardly of the retainer means 30 which is connected to the valve body 28. "Inwardly" and the like refer to a direction or position relatively closer to the longitudinal axis of the tool.

The retainer means 30 includes an elongated member 46 having the biasing means 10 retained therein for engagement with the slide means 8. The retainer means 30 also includes a cap 48 threadedly connected to the top end of the elongated member 46. The cap 48 provides a shoulder 50 which functions as a stop means for defining a limit of travel of the slide means 8 in the upward direction. The cap 48 also defines a barrier against which an upwardly acting force acts in opposition to the biasing force provided by the biasing means 10.

As shown in FIGS. 1C–1E, the valve body 28 is primarily disposed within the valve case 16 so that there is little if any relative movement between the valve case 16 and the valve body 28 in a longitudinal direction. FIGS. 1B–1D disclose that the retainer means 30 is disposed within the housing case 22. These elements are substantially cylindrical with hollow interiors in which the slide means 8 and the biasing means 10 are disposed.

As shown in FIGS. 1C–1D, the slide means 8 of the preferred embodiment includes a sliding sleeve valve comprising a valve member 52 and an extension member 54. The valve member 52 is slidable adjacent the valve body 28, and the extension member 54 is slidable, simultaneously with the valve member 42, adjacent the elongated member 46.

The valve member 52 has at least one port 56 defined therethrough. The valve member 52 is disposed within the pipe string portion 2 so that the port 56 can be positioned along the valve body 28 between a position at which the port 56 is substantially aligned in fluid communication with the port 36 and a position spaced from a port 36, which position in the preferred embodiment is the location f a port 38. To maintain the port 56 fluid-tightly sealed with whichever of the ports 36 or 38 it is in fluid communication, and to fluid-tightly seal the port 56 from the other of such ports 36 or 38 with which it is not then in fluid communication, the valve member 52 has O-rings 58, 60, 62, 64 and Teflon back up rings 66, 68, 70 and 72 associated therewith as shown in FIG. 1D.

To properly position the valve member 52 and the port 56 relative to the ports 36 and 38, the valve member 52 further includes means for cooperating with the stop means defined in a preferred embodiment by the shoulder 44 and means for cooperating with the other stop means defined by the shoulder 50. The means for cooperating with the shoulder 44 is defined in the preferred embodiment by a shoulder 74 which is an outwardly extending flange that engages the shoulder 44 to limit the downward movement of the valve member 52 in response to the biasing force exerted by the biasing means 10. The stop means which cooperates with the shoulder 50 is defined by another shoulder 76 defined by an upper end of the extension member 54. The shoulder 76 engages the shoulder 50 to limit the upward movement of the valve member 52 in response to an opposing force oppositely directed to and greater than, the force exerted by the biasing means 10. When the shoulder 74 engages the shoulder 44, the ports 38 and 56 are in fluid communication, and when the shoulder 76 engages the shoulder 50, the ports 36 and 56 are in fluid communication.

The extension member 54 provides a biasing means engagement arm for engaging and compressing the biasing means 10 when a sufficient opposing force is applied to the sliding sleeve valve. The extension member 54 also responds to a superior biasing force to move the valve member 52 to the lowermost position wherein the ports 38 and 56 are in fluid communication.

Associated with the extension member 54 of the preferred embodiment are a plurality of pins, one of which is shown in FIG. 1C to be threadedly connected in an opening defined through the extension member 54. The pins 78 are inwardly directed so that they protrude as engagement lugs into the hollow interior portion 42 of the pipe string portion 2. These protruding lugs engage the probe portion 4, as will be subsequently described, so that the aforementioned opposing force can be transmitted to the sliding sleeve valve to overcome the biasing force provided by the biasing means 10.

As shown in FIG. 1C, the biasing means 10 includes a spring 80 retained within the retainer means 30 (alternatively denominated a "spring housing" for the preferred embodiment) between the cap 48 and the extension member 54. The spring 80 exerts the aforementioned biasing force against the extension member 54 tending to urge the shoulder 74 into engagement with the shoulder 44. It is this biasing force of the spring 80 which a counter-force applied to the probe portion 4 in engagement with the pins 78 must overcome to move the slide means 8 to a tool-actuated position wherein the port 56 is moved into fluid communication with the port 36.

The probe portion 4 includes mechanical means for moving the slide means 8 from the tool-unactuated position (i.e., the position in which the ports 38 and 56 are in fluid communication) when the aforementioned counterforce, which counterforce is provided by a longitudinal reciprocation of the probe portion 4, is greater than the biasing force exerted by the biasing means 10. The mechanical means includes housing means 82 (FIGS. 1C–1E), connector means 84 (FIG. 1C), jarring means 86 (FIGS. 1B–1C) and coupling means 88 (FIG. 1B).

The housing means 82 is used for receiving a pressure sensor device (not shown). The pressure sensor device is received in a cavity 90 defined within a gauge housing 92 and a nose assembly 94 threadedly and fluid-tightly connected to the gauge housing 92 as shown in FIG. 1D. The cavity 90 includes a portion 96 in which a probe of the pressure sensor device is positioned and a portion 98 defined within the gauge housing 92 in which the electrical circuitry for the pressure sensor device is located. The pressure sensor device may be a Geophysical Research Corporation 512H pressure and temperature gauge which is relatively small so that the mechanical means may be relatively compact; however, other instruments can also be used. For example, multichannel devices, sensor devices having memory for retaining the detected information downhole until the probe portion 4 is extracted from the well, as well as other devices, can be used. It is to be noted that the mechanical means is also made relatively compact because it does not include an actuator sub.

Pressure is communicated to the pressure sensor probe disposed within the cavity portion 96 of the nose assembly 94 via at least one port 100 defined through the wall of the nose assembly 94. The port 100 is maintained in fluid communication with the port 56, but is fluid-tightly sealed from other portions of the tool by means of O-rings 102, 104.

The nose assembly 94 has a plurality of guide fingers 106 pivotally associated therewith for preventing abrasion of O-rings 102 and 104 by contact with the interior of the pipe string. The fingers 106 are biased to pivot in a direction away from the probe portion 4 by suitable biasing means located at the points of connection between the fingers 106 and the nose assembly 94, one of which points of connection is identified in FIG. 1D by the reference numeral 108. To prevent the fingers 106 from extending outwardly an undesirable distance, a retaining ring 110 is provided on the nose assembly 94.

As shown in FIGS. 1D–1E, the nose assembly 94 includes a main body 112 having a conical tip 114 threadedly connected thereto.

The gauge housing 92 includes a substantially cylindrical sleeve element having a recessed region 116 on which the connector means 84 is rotatably disposed in the preferred embodiment. The connector means 84 engages the protruding lug or lugs provided by pins 78 when the probe portion 4 is longitudinally moved into the hollow interior portion 42 of the pipe string portion 2. When this engagement is suitable secured with the protruding lug and the connector means related in a locked position, the sliding sleeve valve can be moved in opposition to the biasing means 10. This locking position is achieved in the preferred embodiment when the probe portion 4 is disposed within the pipe string portion 2 and the ports 56 and 100 are substantially spatially aligned.

Stated differently, the connector means 84 is mounted on the gauge housing 92 for cooperative engagement with the pins 78 for defining a first position and a second position to which the housing means 82 is movable relative to the sliding sleeve valve. The first position is the lowermost position to which the housing means 82 can move relative to the sliding sleeve valve. The second position is the uppermost engaged position to which the housing means 82 can move relative to the sliding sleeve valve when the connector means 84 and the pins 78 are engaged. This second position is also the position of the housing means 82 from which movement of the sliding sleeve valve commences when the aforementioned opposing force greater than the biasing force exerted by the biasing means 10 is applied to the probe portion 4. In the preferred embodiment, the ports 56 and 100 are spaced from each other as shown in FIG. 1D when the housing means 82 is in the first position, and the ports 56 and 100 are substantially spatially aligned when the housing means 82 is in the second position. In the preferred embodiment, the reference numeral 118 identifies the location of the port 100 in the first position, and the reference numeral 120 identifies the location of the port 100 in the second position. Although having different spatial relationships between the first and second positions, the ports 56 and 100 are always in fluid communication in each of these positions as is apparent from the illustrated spacing of the O-rings 102, 104.

Figure 3:
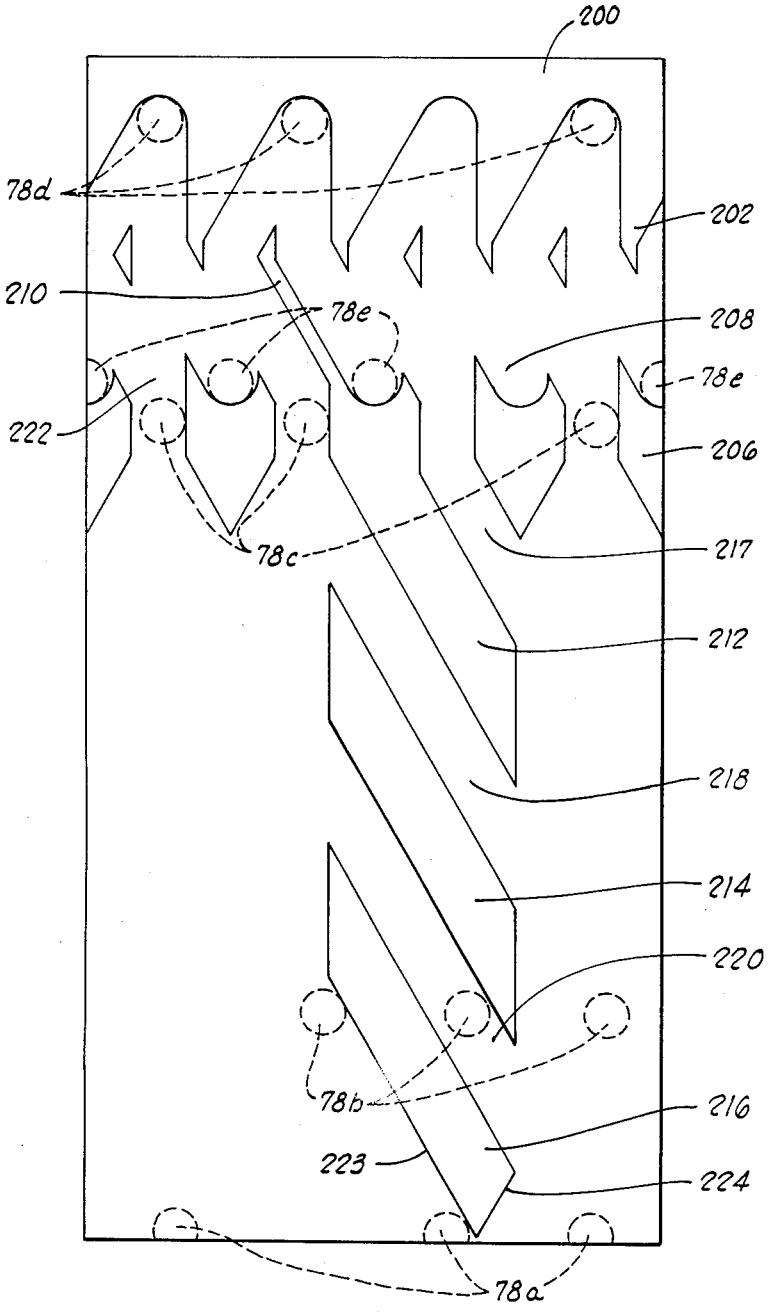
FIG. 3 is a development of the preferred channel means of the connector mechanism of the present invention.

With reference to FIG. 3, the preferred embodiment of the connector means 84 of the present invention will be described. The connector means 84 of the preferred embodiment includes a collar 124 rotatably mounted on the gauge housing 92 and further having channel means defined on the exterior of collar 124. The channel means cooperate with pins 78 so that the positions 118 and 120 are defined and further so that the valve member 52 is moved between the limits of travel defined by the shoulders 44, 74 and 50, 76.

The channel means on collar 124 is defined by a plurality of lands extending radially outwardly from the surface thereof. As the top of collar 124, major land 200 includes a plurality of downwardly extending peninsulas 202 at 90° intervals defining bays 204 therebetween.

Below peninsulas 202 lie support islands 206 at 90° intervals defining upwardly facing support coves 208. One of the support islands 206 also includes deflector headland 210, the latter extending obliquely upwardly from the main body of the island, which itself extends obliquely downwardly to form alignment headland 212 at its lower extent.

Longitudinally below alignment headland 212 lie a plurality of alignment islands 214 and 216, there being parallel alignment channels 217, 218 and 220 defined between headland 212 and an adjacent support island 206, headland 212 and island 214, and island 214 and island 216, respectively. The bottom of alignment island 216 is defined by oblique alignment edges 223 and 224.

Longitudinal passages 222 extend between support islands 206.

Pins 78 are disposed at 90° intervals in extension member 54, there being three (3) pins 78 in the preferred embodiment, thus leaving an open or blank position of 180° on the interior of extension member.

The manner of interaction of pins 78 with collar 124 will be subsequently described in conjunction with the operation of the downhole tool in the context of the conduct of a tubing conveyed perforating and drill stem testing operation.

The connector means 84 is associated with the top portion of the gauge housing 92 near a threaded end which is connected to the jarring means 86 by a suitable coupling member 144. The jarring means 86 includes a jar case 146 and a jar mandrel 148, connected to the gauge housing 92 through threaded engagement with the coupling member 144, for retaining the jar case 146 in sliding relationship with the housing means 82. The jar case 146 includes a slot 150 through which the heads of a plurality of screws 152 extend from the jar mandrel 148 for permitting the sliding relationship, but for preventing circumferential or torsional movement of the jar case 146 relative to the jar mandrel 148 and housing means 82.

The jar case 146 includes a striker block portion 151 located at the lower end of the slot 150. The striker block 151 is movable, as will be subsequently described, between an upper flange 153 of the jar mandrel means and a lower flange 155 of the jar mandrel means, which lower flange 155 is specifically established by the upper edge of the coupling member 144.

The jar case 146 is a substantially cylindrical, hollow member having electrical connectors disposed therein for providing electrical continuity between the electrical circuitry of the pressure sensor device located in the housing means 82 and a wireline connected to the probe portion 4. As shown in FIG. 1B, the electrical continuity is provided by insulated electrically conductive springs 154. The springs 154 are disposed so that their spirals are oppositely directed to prevent the springs 154 from becoming meshed. One of the springs connects the wireline with an electrical conductor 157 (FIG. 1C) connected to the electrical circuitry of the pressure sensor device, and the other spring provides ground continuity with the electrically conductive metal of which the elements of the present invention are constructed. To secure insulated electrical conductors extending from the springs 154 against movements of the jarring means 86, the jar case 146 has standoff members 156, 158 suitable retained therein for applying a pressure to the insulated conductors running under feet 160, 162 thereof. The electrical conductor extending under the foot 160 is electrically connected with a pin 164 (FIG. 1B) which is subsequently electrically connected, by suitable means known to the art, to the electrical circuitry of the pressure sensor device. A rubber boot 166 is disposed around the electrical conductor and pin 164 within the standoff element 156. As shown in the drawings, a similar construction is used with respect to the standoff member 158.

Through the standoff member 158, electrical continuity is provided to the coupling means 88, which is a top coupling member 168 suitable constructed for receiving an electrical adapter, sinker bars and cable head through which the wireline is connected to the probe portion 4 as known to the art.

With reference to FIGS. 1, 2, and 3, a use of a downhole tool employing the preferred embodiment of the present invention will be described. Initially, the pipe string portion 2 is made up as a part of a pipe string 170 (which, as previously described, can be a tubing string or other structure which is identified herein under the name "pipe string"). Also forming portions of the pipe string 170 are a tester valve 172 and a packer 174. The tester valve 172 is of any suitable type as known to the art, such as a Halliburton Services APR®-N or LPR TM -N tester valve for use in a cased hole. The packer 174 is also of a suitable type as known to the art, such as a Halliburton Services RTTS hook wall packer or open hole testing packer. Below packer 174 is tubing conveyed perforating gun assembly 175 of any type such as is well known in the art, and available from Vann Systems Division of Halliburton Company, Baker Oil Tools, Dresser Industries, or a number of other vendors.

In the embodiment shown in FIG. 1E, the tester valve 172 includes a ball valve member 190 actuated by valve actuator arms 92 as known to the art. The tester valve 172 also includes a port 194 for communicating reservoir fluid and pressure to the pipe string portion 2 even when the ball valve member 190 is closed.

The pipe string 170 in FIG. 2 is disposed in a well 176 having a casing 178 disposed therein by way of example and not by way of limitation. The packer 174 is set as known to the art. With this installation completed, the probe portion 4 of the present invention can be lowered into the pipe string 170 for engagement with the pipe string portion 2 of the present invention so that drill stem tests, for example, can be conducted after the formation is perforated by perforating gun assembly 175.

The probe portion 4 is moved into and out of the well 176 on a wireline cable 180 which is part of a wireline unit of a type as known to the art. Movement of the wireline cable 180 is by suitable hoist means included in the wireline unit as known to the art.

Associated with the wireline unit, as shown in FIG. 2, is a data collection system of a type as known to the art for retrieving and processing the electrical information received from the probe portion 4 via the wireline cable 180. In an embodiment of a suitable data collection system known to the art, pressure versus time plots can be developed and the well's productivity, static reservoir pressure, transmissibility, actual flow capacity, permeability, and formation damage can be calculated, plotted and printed at the well site. The data collection system also includes means for displaying the real-time pressure readings taken by the preferred embodiment of the present invention.

For this utilization schematically illustrated in FIG. 2, the probe unit 4 is placed into the well 176 through pressure control equipment 182 of a type as known to the art. The pressure control equipment 182 includes a pressure control unit, a wireline blowout preventor valve, and a lubricator stack of types as known to the art. The pressure control unit proved hydraulic pressure to the wireline blowout preventor valve, the lubricator stack and the wireline unit. The pressure control unit also supplies grease, injected under pressure, methanol injection and a pneumatic supply to the lubricator stack.

The wireline blowout preventor valve is used in conjunction with the lubricator stack when operations under pressure are to be performed. This valve is hydraulically operated and controlled by the pressure control unit.

The lubricator stack provides a means for installing the probe portion 4 in preparation of entering the well while the well 176 is under pressure. With the probe portion 4 so installed, the wellhead valve is opened to allow entry into the wellbore as known to the art.

With reference to all the drawings, a more particular description of the method of using the present invention will be provided, including the steps of disposing the pipe string portion 2 into the well 176 so that the valve means of the pipe string portion 2 is located downhole in association with the tester valve 172.

The probe portion 4 is connected with the wireline cable 180 and inserted into the well 176 through the pressure control equipment 182. The hoist means of the wireline unit is actuated to unreel the wireline cable 180, thereby lowering the probe portion 4 into the well toward the pipe string portion 2. This lowering is continued until one of the pins 78 is contacted by oblique edge, 223 at the lower end of alignment island 216, as shown in phantom in FIG. 3 as position 78*a*. Again, the interaction of pin 78 with collar 124 will be described in terms of pin movement for greater clarity, although pins 78 are in fact stationary while collar 124 moves with probe portion 4 and rotates on gauge housing 92. It should also be understood that initial contact of any of the pins 78 with either lower edge 223 or 224 will result in proper alignment of pins 78, as such contact will cause rotation of collar 124 until proper alignment is reached.

The three pins 78, subsequent to probe portion 4 contact, are initially guided obliquely upwardly by the lower edge of alignment island 216 (see FIG. 3, position 78*b*) and then also by alignment channels 218 and 220, into passages 222 (position 78*c*). Contact of one of the pins 78 with the underside of deflector headland 210 guides all three pins, which are of course spatially fixed with respect to one another, into bays 204 (position 78*d*). At this position, the ports 36, 38, 56 and 100 are disposed as shown in FIG. 1D. In this position, the probe portion 4 is unable to be lowered any farther into the well 176.

Next, the hoist means is actuated to reel in the wireline cable 180 so that the probe portion 4 is moved upwardly relative to the pipe string portion 2. This movement causes the pins 78 to travel to support coves 208 (position 78*e*), due to the guidance of the upper side of deflector headland 210 on one of pins 78.

With the pin 78 locked against support islands 206, the hoist means is further actuated to tension the wireline cable 180 with a force which is greater than the biasing force exerted by the spring 80. In the preferred embodiment, this force is approximately 600 pounds. When this force is applied by the hoist means to the wireline 180, the probe portion 4 continues to be lifted and support islands 206 act against the pins 78 to move the sliding sleeve valve member 52 upward against the spring 80. This upward movement can be continued until the shoulder 76 engages the shoulder 50. When the shoulder 76 engages the shoulder 50, the ports 56 and 100, which ports have been maintained in substantial spatial alignment through the locking engagement of the pins 78 and support islands 206, are moved into substantial spatial alignment and, more generally, fluid communication with the port 36. This positioning is indicated by the line in FIG. 1D identified with the reference numeral 184. In this position, the fluid pressure which is present in the port 36 is communicated to the cavity 90 whereby the well pressure is sensed by the pressure sensor device located in the housing means 82. That the pressure from the well is present in the port 36 is indicated by the pressure and fluid flow path identified by the arrows labeled with the reference numerals 186*a*–186*f*.

With the ports 36, 56 and 100 at the position 184, perforating guns 175 are actuated by means known in the art, such as application of annulus pressure or tubing pressure, or electrical actuation through wireline 180, after the valve 172 is opened. The tester valve 172 is then actuated several times to perform a drill stem test as known in the art by alternately flowing and closing off the perforated producing formation. The pressures resulting from the drill stem test are detected by the pressure sensor device contained in the probe portion 4. The detected pressures are converted into corresponding electrical signals which are transmitted to the surface over the wireline cable 180. Although the electrical signals are intended, as shown herein, to be communicated to the surface for providing a real-time surface readout via the data collection system, the present invention is contemplated for use with a slick line and detector devices which have self-contained electrical power sources and memories for retaining data corresponding to the detected pressures, temperatures and other parameters until after the probe unit 4 is extracted from the well. Furthermore, the broad aspects of the present invention can also be used with other devices, both electrical and non-electrical, which may detect parameters other than pressure in a downhole environment.

Once the testing has been conducted with the illustrated preferred embodiment, the tester valve 172 is closed and the tension is released from the wireline cable 180 so that the probe unit 4 is lowered relative to the pipe string portion 2. This lowering continues until the pins 78 again contact peninsulas 202 of major land 200, and re-enter bays 204; it will be appreciated, however, that each pin 78 will advance to the next bay to the right of the one previously receiving it, such advancement being caused by deflector headland 210. When this engagement occurs, the ports 56 and 100 are returned to their positions as shown in FIG. 1D. As the pins 78 move and the ports 56 and 100 return to their positions as shown in FIG. 1D, the pressure from the cavity 90 of the housing means 82 is vented through the ports 38, 56 and 100 which are maintained in fluid communication. This pressure venting occurs along the path identified by the arrows labeled with the reference numerals 188*a*–188*c*. This pressure relieving operation is important because it relieves the pressure on the O-rings 102 and 104 so that the probe portion 4 can be more easily removed from the wall.

When desired to decouple or disengage probe unit 4 from pipe string portion 2, additional upward and downward reciprocation of probe unit 4 is effected by wireline cable 180 until all three pins 78 have advanced beyond deflector headland 210, at which point probe unit 4 may be pulled upward to the surface, pins 78 exiting through passages 222 between islands 206, there being no further interaction with any lands which would deflect them into coves 208.

The aforementioned additional upward and downward reciprocation required to decouple probe unit 4 prevents inadvertent decoupling due to the perforating gun shock wave. Thus, even if probe unit 4 moves upwardly and downwardly due to such shock, it remains engaged with pipe string portion 2. Of course, the preferred embodiment utilizing these pins 78 and form bays 204 is merely illustrative, providing three coupled or "latched in" positions. An arrangement using a lesser number of pins and bays (for fewer latched-in positions) is also possible, and contemplated within the ambit of the invention. Generally, if not limited by the available surface area on collar 124, the number of pins and alignment channels can be N, wherein $N \geqq 2$, and the number of bays and support coves is equal to $N+1$. The angle of orientation of alignment islands 214 and 216, deflector headland 210 and alignment headland 212 would, of course, be adjusted for a greater or lesser number of pins and bays, as it would also for different collar diameters.

The coupling and decoupling of the connector means 84 and the pin 78 generally achieved by the longitudinal reciprocating movement of the wireline cable 180 can be facilitated by using the jarring means 86. If the coupling between the connector means 84 and the pin 78 is stuck and the probe portion 4 needs to be moved down into the well farther, the wireline cable 180 can be withdrawn so that the jar case 146 is positioned with the striker block 151 adjacent the upper flange 153 of the jar mandrel 148. With the striker block 151 so positioned, the wire-line cable 180 can be released so that the striker block 151 and portions connected thereto move rapidly downwardly to apply force impulse to the lower flange 155 of the jar mandrel means. If the connection between the connector means 84 and the pin 78 is stuck and the probe portion 4 needs to be moved in an upward direction, the aforementioned procedure can be reversed wherein the striker block 151 is positioned adjacent the flange 155 as shown in FIG. 1A and then moved rapidly upwardly by rapid intake of the wireline cable 180 on the hoist means so that the striker block 151 applies a force impulse to the upper flange 153 of the jar mandrel 148.

DETAILED DESCRIPTION OF AN ALTERNATIVE EMBODIMENT

Figure 4:
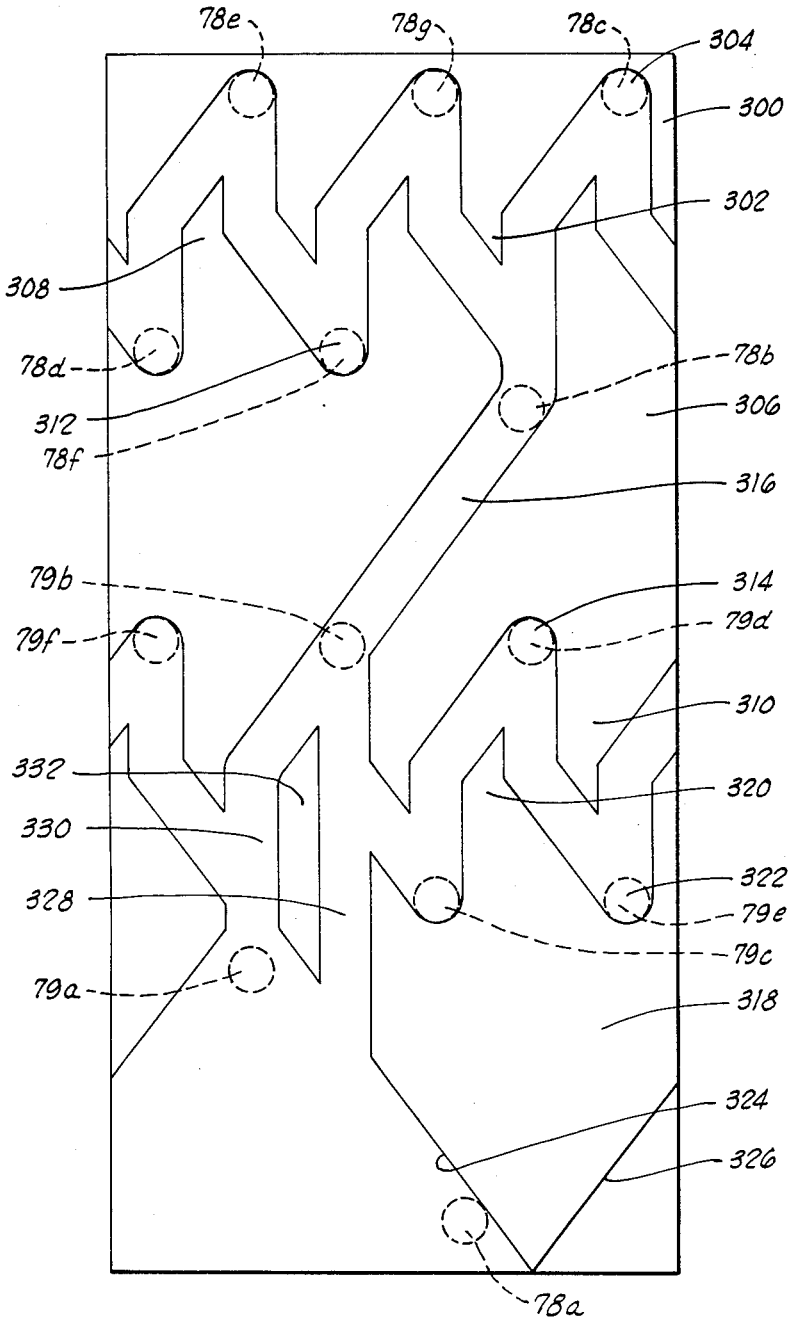
FIG. 4 is a development of the alternative channel means of the connector mechanism of the present invention.

Referring now to FIGS. 1, 2 and 4 of the drawings, an alternative embodiment of the connector mechanism of the present invention will be described, which alternative embodiment employs a probe unit and pipe string portion identical to that of the preferred embodiment, differing only in pin and collar arrangement.

The alternative connector mechanism employs two pins, 78 and 79, longitudinally staggered and on generally diametrically opposite sides of the interior of extension number 54. Top pin 78 acts as a guide for bottom pin 79, both pins following a path on collar 124 that differs from that of the preferred embodiment. A development of this alternative path is shown in FIG. 4.

Collar 124, is this alternative embodiment, includes a major land 300 at the top thereof, including downwardly extending peninsulas 302 defining upper bays 304. Below major land 300, support island 306 including upwardly extending peninsulas 308 at the top thereof and downwardly extending peninsulas 310 at the bottom thereof defines upper support coves 312 at the top thereof and lower bays 314 at the bottom thereof. Entry/exit channel 316 extends longitudinally obliquely between the lateral edges of support island 306. Below support island 306 is disposed alignment island 318 including upwardly extending peninsulas 320 defining lower support coves 322. The bottom of alignment island 318 is defined by oblique alignment edges 324 and 326. Entry/exit passages 328 and 330 are defined between adjacent lateral edges of alignment island 318 and longitudinally extending barrier island 332 disposed therebetween.

In operation, when probe unit 4 is lowered into the well 176 via wireline cable 180, top pin 78 will contact a lower edge of alignment island 318. As with the preferred embodiment, it is immaterial which lower edge, 324 or 326, or which island 318, is contacted. However, unlike the preferred embodiment, the path of the channel means is repeated twice, due to the use of circumferentially offset, longitudinally staggered pins 78 and 79. Assuming top pin 78 contacts, alignment edge 324 as shown in FIG. 4 (position 78*a*), top pin 78 will ride on edge 324 into entry/exit passage 328 as collar 124 rotates, and then proceed into entry/exit channel 316 to position 78*b*. At this point, lower pin 79 will be aligned with entry/exit passage 330 (position 79*a*). Next, pins 78 and 79 move simultaneously, with further lowering of probe unit 4, into positions 78*c* and 79*b*, respectively, top pin 78 residing in upper bay 304 and bottom pin 79 at the lower end of entry/exit channel 316.

An upward pull on wireline cable 180 will place top and bottom pins 78 and 79 in positions 78 d and 79*c*, respectively, in an upper support cove 312 and a lower support cove 322. Further upward pull will, as described previously with respect to the preferred embodiment, move the sliding sleeve valve member 52 upward against spring 80 until shoulder 76 engages shoulder 50, at which point ports 56 and 100 are moved into fluid communication with port 36 (see reference numeral 184 for general identification of the referenced positioning).

Tester valve 172 is opened, perforating guns 175 are fired, and a drill stem test conducted as is known in the art and previously described. The shock wave of the guns firing may cause pins 78 and 79 to jump, or reciprocate, in collar 124, but as can readily be seen in FIG. 4, such reciprocation (to positions 78*e* and 79*d*) will not cause disengagement or decoupling of probe unit 4 from pipe string portion 2.

Assuming that no "jumping" has in fact taken place, additional reciprocations of probe unit 4, after the drill stem test is conducted, will move top pin 78 from position 78*d* to 78*g* (via positions 78*e* and 78*f*), and probe unit 4 will cause top pin 79 to reenter channel 316, and bottom pin 79 to reenter passage 330. Continued upward probe movement will cause both pins to exit collar 124, and probe unit 4 can be withdrawn to the surface by wireline cable 180.

While the alternative embodiment has been shown with two "up" or fully latched-in positions for pins 78 and 79, it is contemplated that three or even more positions can be accommodated by proper slot sizing and orientation, for a given collar diameter. As with the alternative embodiment shown, the slot pattern would be repeated twice on the exterior of collar 124.

From the foregoing it is apparent that the present invention provides a downhole tool which is mechanically actuated and deacuated without the need for any downhole electrical equipment, and, further, which cannot be inadvertently deactuated by firing of perforating guns. This purely mechanical operation can be assisted by the described jarring means if necessary or desired.

Thus, the present invention is well adapted to carry out the objects and attain the ends and advantages mentioned above as well as those inherent therein. While a preferred and an alternative embodiment of the invention has been described for the purpose of this disclosure, numerous other changes in the construction and arrangement of parts can be made by those skilled in the art, which changes are encompassed within the spirit of this invention as defined by the appended claims.

For example and not by way of limitation, the pins could be secured to a rotating collar to follow a channel means path in a stationary element; rotation of the probe could be accommodated by a swivel connection with the wireline cable, or by twisting of the cable itself; the pins could be placed on the probe and the collar on the interior of the pipe string portion, with the channel means path turned upside-down; and combinations of the above.

I claim:

1. An apparatus for releasably connecting a probe to a pipe string portion of a downhole tool, comprising:

pin means, protruding form one of said probe and said pipe string portion, for effecting a connection therebetween, wherein said pin means comprises three pins spaced circumferentially at 90° intervals;

channel means, on the other of said probe and said pipe string portion for receiving said pin means when said probe is lowered into proximity with said pipe string portion, for latchingly engaging said pipe string portion and said probe upon subsequent upward movement of said probe, and for maintaining said latching engagement through at least one subsequent downward and upward reciprocation of said probe, wherein said channel means comprises a circumferential path defined by a plurality of radially extending lands on a collar;

alignment means for aligning said pin means with said channel means;

wherein said lands comprise:

a major land at the top of said collar including a plurality of downwardly extending peninsulas;

a plurality of support islands below said peninsulas;

an obliquely upwardly extending deflector headland associated with one of said support islands; and wherein said alignment means comprises:

an obliquely downwardly extending alignment headland associated with said one of said support islands; and a plurality of obliquely downwardly extending alignment islands below said alignment headland and in substantially parallel relationship thereto.

2. The apparatus of claim 1, wherein:

said peninsulas defined downwardly facing bays therebetween;

said support islands define upwardly facing support coves thereon and longitudinal passages therebetween; and said alignment headland one of said support islands and said alignment islands defining alignment channels therebetween.

3. The apparatus of claim 2, wherein the lowermost of aid alignment islands includes obliquely extending alignment edges at the bottom thereof, one of said edges being oriented in substantially parallel relationship to said alignment channels.

4. An apparatus for releasably connecting a probe to a pipe string portion of a downhole tool, comprising:

pin means, protruding form one of said probe and said pipe string portion, for effecting a connection therebetween, wherein said pin means comprises a plurality of circumferentially spaced pins, said plurality including at least two pins;

channel means, on the other of said probe and said pipe string portion for receiving said pin means when said probe is lowered into proximity with said pipe string portion, for latchingly engaging said pipe string portion and said probe upon subsequent upward movement of said probe, and for maintaining said latching engagement through at least one subsequent downward and upward reciprocation of said probe, wherein said channel means comprises a circumferential path defined by a plurality of radially extending, lands on a collar;

alignment means for aligning said pin means with said channel means;

wherein said lands comprise:

a major land at the top of said collar including a plurality of downwardly extending peninsulas;

a plurality of support islands below said peninsulas;

an obliquely upwardly extending deflector headland associated with one of said support islands;

an obliquely downwardly extending alignment headland associated with said one of said support islands; and a plurality of obliquely downwardly extending alignment islands below said alignment headland and in substantially parallel relationship thereto.

5. The apparatus of claim 4, wherein:

said peninsulas define a plurality of downwardly facing bays therebetween, wherein said plurality of bays being equal to the number of said plurality of pins plus one;

said support islands define a plurality of upwardly facing support coves thereon, wherein said plurality of support coves being equal to the number of said plurality of pins plus one; and said alignment headland, said support island and said alignment islands define a plurality of alignment channels therebetween, wherein said plurality of alignment channels being equal in number to said plurality of pins.

6. The apparatus of claim 5, wherein the lowermost of said alignment islands includes obliquely extending alignment edges at the bottom thereof, one of said edges being oriented in substantially parallel relationship to said alignment channels.

7. An apparatus for releasably connecting a probe to a pipe string portion of a downhole tool, comprising:

pin means, protruding from one of said probe and said pipe string portion, for effecting a connection therebetween, wherein said pin means comprises two longitudinally staggered, generally diametrically opposed pins;

channel means, on the other of said probe and said pipe string portion for receiving said pin means when said probe is lowered into proximity with said pipe string portion, for latchingly engaging said pipe string portion and said probe upon subsequent upward movement of said probe, and for maintaining said latching engagement through at least one subsequent downward and upward reciprocation of said probe, wherein said channel means comprises two longitudinally separated, circumferential paths defined by a plurality of radially extending lands on a collar;

alignment means for aligning said pins means with said channel means;

wherein said lands comprise:

a major land at the top of said collar including a plurality of downwardly extending peninsulas;

a support island below said major land, including a plurality of upwardly extending peninsulas and a plurality of downwardly extending peninsulas;

an alignment island below said support island, including a plurality of upwardly extending peninsulas.

8. The apparatus of claim 5, wherein:

said major land peninsulas define upper bays therebetween;

said support island upwardly extending peninsulas define upper support cover therebetween;

said support island downwardly extending peninsulas define lower bays therebetween;

said alignment island peninsulas define lower support coves therebetween; and said support island defines an obliquely extending entry/exit channel between the lateral edges thereof.

9. The apparatus of claim 8, wherein:

said lands further include a barrier island between said alignment island lateral edges at the lower extent of said entry/exit channel, and defining with said alignment island entry/exit passages in communication with said entry/exit channel.

10. The apparatus of claim 9, wherein the bottom of said alignment island is defined by obliquely extending alignment edges.

11. An apparatus for releasably connecting probe to a pipe string portion of a downhole tool, comprising:

pin means, protruding from one of said probe and said pipe string portion for effecting a connection therebetween;

channel means, on the other of said probe and said pipe string portion, for receiving aid pin means w hen said probe is lowered into proximity with said pipe string portion, for latchingly engaging therewith upon subsequent upward movement of said probe, and for maintaining said latching engagement through at least one subsequent downward and upward reciprocation of aid probe;

wherein said pin means includes three circumferentially spaced pins, spaced at 90° intervals and said channel means includes a plurality of radially extending lands which define a circumferential path, and a collar with said radially extending lands disposed thereon;

wherein said lands include:

a major land at the top of said collar with a plurality of downwardly extending peninsulas;

a plurality of support islands below said peninsulas;

an obliquely upwardly extending deflector headland associated with one of said support islands;

an obliquely downwardly extending alignment headland associated with said one of aid support islands; and a plurality of obliquely downwardly extending alignment islands below said alignment headland and in substantially parallel relationship thereto;

wherein said peninsulas define downwardly facing bays therebetween;

said support islands define upwardly facing support coves thereon and longitudinal passages therebetween;

said alignment headland, one of said support islands and said alignment islands defining alignment channels therebetween; and wherein the lowermost of said alignment islands includes obliquely extending alignment edges at the bottom thereof, one of said edges being oriented in substantially parallel relationship to said alignment channels.

12. An apparatus for releasably connecting a probe to a pipe string portion of a downhole tool, comprising:

pin means, protruding from one of said probe and said pipe string portion for effecting a connection therebetween;

channel means, on the other of said probe and said pipe string portion, for receiving said pin means when said probe is lowered into proximity with said pipe string portion, for latchingly engaging therewith upon subsequent upward movement of said probe, and for maintaining said latching engagement through at least one subsequent downward and upward reciprocation of said probe;

wherein said pin means includes two longitudinally staggered, generally diametrically opposed pins and said channel means includes a plurality of radially extending lands which define two longitudinally separated circumferential paths, and a collar with said radially extending lands disposed thereon;

wherein said lands comprise:

a major land at the top of said collar including a plurality of downwardly extending peninsulas;

a support island below said major land, including a plurality of upwardly extending peninsulas and a plurality of downwardly extending peninsulas;

an alignment island below said support island, including a plurality of upwardly extending peninsulas.

wherein said major land peninsulas define upper bays therebetween;

said support island upwardly extending peninsulas define upper support coves therebetween;

said support island downwardly extending peninsulas define lower bays therebetween;

said alignment island peninsulas define lower support coves therebetween;

said support island defines an obliquely extending entry/exit channel between the lateral edges thereof;

wherein said lands further include a barrier island between said alignment island lateral edges at the lower extent of said entry/exit channel, and defining with said alignment island entry/exit passages in communication with said entry/exit channel; and wherein the bottom of said alignment island is defined by obliquely extending alignment edges.

* * * * *